US007121518B2

(12) United States Patent
Hovde et al.

(10) Patent No.: US 7,121,518 B2
(45) Date of Patent: Oct. 17, 2006

(54) PORTABLE WORKSTATION AND CARRYING CASE

(76) Inventors: Arthur M. Hovde, 313 1/2 Ramsey St., Hastings, MN (US) 55033; Thomas E. Kramer, 13228 Bittersweet St. NW., Coon Rapids, MN (US) 55448; Mark J. Weimholt, 1326 - 97th Ave. NW., Coon Rapids, MN (US) 55433

( * ) Notice: Subject to any disclaimer, the term of this patent is extended or adjusted under 35 U.S.C. 154(b) by 0 days.

(21) Appl. No.: 10/248,501

(22) Filed: Jan. 24, 2003

(65) Prior Publication Data

US 2004/0144907 A1 Jul. 29, 2004

(51) Int. Cl.
*A47B 97/04* (2006.01)

(52) U.S. Cl. ..... 248/460; 248/461; 108/38

(58) Field of Classification Search ..... 248/461, 248/462, 460, 463, 165, 166, 167; 108/34, 108/35, 38, 50.01, 157.1; 206/320; 361/683
See application file for complete search history.

(56) References Cited

U.S. PATENT DOCUMENTS

| | | | | |
|---|---|---|---|---|
| 2,977,566 | A | 3/1961 | Neumann et al. | |
| 3,027,664 | A * | 4/1962 | Dailey | 108/34 |
| 3,137,953 | A * | 6/1964 | Foster | 38/30 |
| 3,326,337 | A * | 6/1967 | Bell | 190/11 |
| 3,596,866 | A * | 8/1971 | Baker | 248/461 |
| 3,699,673 | A * | 10/1972 | Foster et al. | 38/30 |
| 4,021,013 | A | 5/1977 | Wiersma | |
| 4,371,077 | A * | 2/1983 | Solitt et al. | 206/759 |
| 4,410,158 | A | 10/1983 | Maffei | |
| 4,465,255 | A | 8/1984 | Hill | |
| 4,496,126 | A | 1/1985 | Melton et al. | |
| 4,801,120 | A | 1/1989 | Gregoire | |
| 4,830,328 | A | 5/1989 | Takach, Jr. et al. | |
| 4,848,710 | A | 7/1989 | Newman | |
| 4,854,538 | A | 8/1989 | Von Schalscha | |
| 4,978,096 | A | 12/1990 | Struckmann | |
| 5,054,771 | A | 10/1991 | Mansfield | |
| 5,100,098 | A | 3/1992 | Hawkins | |
| 5,161,766 | A | 11/1992 | Arima | |
| 5,195,709 | A | 3/1993 | Yasushi | |
| 5,207,405 | A | 5/1993 | Cobb | |
| 5,221,070 | A | 6/1993 | Heilmer | |
| 5,293,825 | A | 3/1994 | Cauffiel | |
| 5,445,266 | A | 8/1995 | Prete et al. | |
| 5,476,304 | A | 12/1995 | Gulliver et al. | |

(Continued)

FOREIGN PATENT DOCUMENTS

JP 08164170 6/1996

(Continued)

OTHER PUBLICATIONS

InsTand (TM); The insTand Catalog; www.instand.com; Oct. 31, 2002 (5 pages).

(Continued)

*Primary Examiner*—Gwendolyn Baxter
*Assistant Examiner*—Tan Le
(74) *Attorney, Agent, or Firm*—Larkin Hoffman Daly & Lindgren Ltd.; Thomas J. Oppold, Esq.

(57) ABSTRACT

A portable workstation that is collapsible into a carrying case. The portable workstation comprises an articulating support structure and an enclosure structure that cooperate between an open usable position and a closed carrying case position. In the closed carrying case position, the articulating support structure is substantially enclosed within the enclosure structure.

13 Claims, 18 Drawing Sheets

U.S. PATENT DOCUMENTS

| | | | | |
|---|---|---|---|---|
| 5,540,159 | A | 7/1996 | Anderson | |
| 5,630,566 | A | 5/1997 | Case | |
| 5,633,782 | A | 5/1997 | Goodman et al. | |
| 5,658,222 | A * | 8/1997 | Brown | 482/52 |
| 5,709,365 | A | 1/1998 | Howard | |
| 5,720,465 | A | 2/1998 | Peltzer et al. | |
| 5,769,369 | A | 6/1998 | Meinal | |
| 5,779,305 | A | 7/1998 | Hocking | |
| 5,868,079 | A | 2/1999 | Charny | |
| 5,893,607 | A | 4/1999 | Trimnell | |
| 5,899,421 | A | 5/1999 | Silverman | |
| 5,915,661 | A | 6/1999 | Silverman et al. | |
| 5,979,857 | A | 11/1999 | Holm | |
| 5,984,347 | A | 11/1999 | Blanc-Rosset | |
| 5,997,147 | A | 12/1999 | Tatoian | |
| 6,021,720 | A | 2/2000 | Boos et al. | |
| 6,056,363 | A | 5/2000 | Maddox | |
| 6,076,787 | A | 6/2000 | Troyer | |
| 6,098,936 | A | 8/2000 | Birrell | |
| 6,102,476 | A | 8/2000 | May et al. | |
| 6,145,926 | A | 11/2000 | Lin | |
| 6,260,486 | B1 | 7/2001 | Boos et al. | |
| 6,264,161 | B1 | 7/2001 | Waggoner | |
| 6,269,753 | B1 | 8/2001 | Roddan | |
| 6,315,252 | B1 | 11/2001 | Schultz | |
| 6,327,982 | B1 | 12/2001 | Jackson | |
| 6,349,825 | B1 | 2/2002 | Swinger et al. | |
| 6,352,155 | B1 | 3/2002 | Barber | |
| 6,389,992 | B1 | 5/2002 | Miller | |
| 2001/0022257 | A1 | 9/2001 | Sadow | |
| 2002/0027767 | A1 | 3/2002 | Ryder | |
| 2002/0063072 | A1 | 5/2002 | Pham | |
| 2002/0100398 | A1 | 8/2002 | Santini | |

FOREIGN PATENT DOCUMENTS

| | | |
|---|---|---|
| JP | 08164171 | 6/1996 |
| JP | 11167459 | 6/1999 |

OTHER PUBLICATIONS

The Boser (TM) Patented Laptop Mobility; Overland Park, KS (1 page).
Tabletote (TM) A division of PC Tables, LLC (1 page).
AJ Prindle & Company; mobile desk; www.ajprindle.com (3 pages).
AJ Prindle & Company, mobile desk & Laptop Bag; www.ajprindle.com (3 pages).
Personal Computing Environments; www.mypce.com (2 pages).

* cited by examiner

FIG. 1
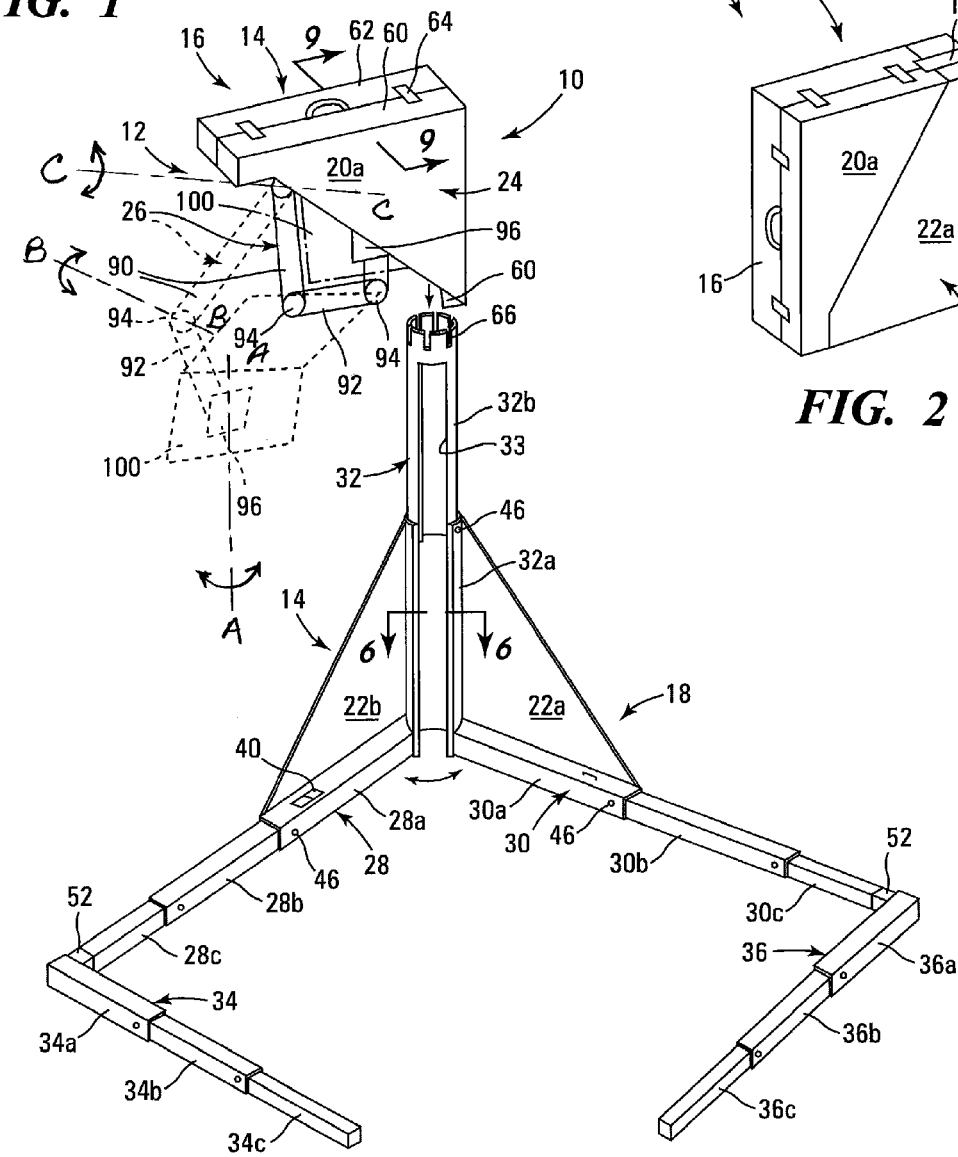
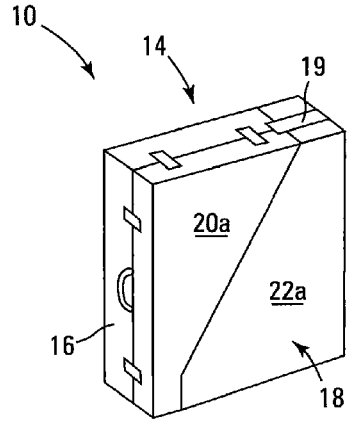
FIG. 2

PORTABLE WORKSTATION AND CARRYING CASE

BACKGROUND OF INVENTION

1. Field of the Invention

The present invention relates to workstations and more particularly to portable workstations for portable computing devices and the like.

2. Description of the Related Art

For those who often spend hours at a time working on computers or playing video games or "surfing" the Internet, the ability to adjust the position of the keyboard, monitor and other user interface devices to comfortable and ergonomic positions is particularly desirable. Various types of computer stands or workstations, such as those disclosed in U.S. Pat. Nos. 5,630,566; 5,779,305; 6,056,363; 6,098,936; 6,102,476 and 6,145,926, have been developed in an attempt to address this need. While the above-identified workstations may serve their intended purpose, it appears that they are intended strictly for home or office use only, in that they are incorporated into a reclinable chair or they are intended to replace a conventional desk or other office furniture.

With the advances in computer technology in the portable computer industry with respect to processor speed, memory, data storage capacity and improvement of the displays, most portable computers now have the functionality that, even within the last few years, was only available in desktop computers. Along with these advances in technology, the price of portable computers have continually decreased enabling more and more users to afford the convenience of portable computers. In addition, due to the ever increasing popularity of the Internet and reliance on e-mail for both business and personal use, more and more people are traveling with their portable computers on business trips, vacations or carrying their portable computers between home and work so they can stay "connected" with their office, friends or family.

Most commercially available portable computer carrying cases or bags provide the necessary ability to easily transport portable computers and the various accessories needed to provide the functionality for using the computer and gaining access to the Internet. Unfortunately, while a user is able to carry virtually everything he or she may need to use the computer in a computer bag or briefcase, when using the portable computer, the user typically places the portable computer on a desk, table, stand or on the user's lap which is often uncomfortable and ergonomically improper.

Accordingly, there is a need in the industry for a portable workstation that provides the ergonomic features and functionalities of a sturdy, stationary workstation, but which is easily collapsible and lightweight so it can be carried with the portable computer so it can be used virtually anywhere the user desires.

Others have attempted to devise carrying cases which allow the user some adjustability of the portable computer by allowing the user to tilt the computer within the carrying case by a tilt-up hinge mechanism. Examples of such devices disclosed in U.S. Pat. Nos. 6,349,825; 6,352,155 and in U.S. Patent Application Publication US 2002/0063072. While each of these devices may serve their intended purpose, these devices lack an articulating support structure which enables both horizontal and vertical movement of the computer in any direction such that the user can position the portable computer in virtually any ergonomically desirable or comfortable position.

SUMMARY OF INVENTION

The present invention is a portable workstation that is collapsible or otherwise transformable into a carrying case. The portable workstation comprises an articulating support structure and an enclosure structure that cooperate between an open usable position and a closed carrying case position. In the closed carrying case position, the articulating support structure is substantially enclosed within the enclosure structure.

The articulating support structure is preferably comprised of a telescoping post and a multi-jointed or articulating arm which supports a peripheral support. The articulating arm enables the peripheral support to be movably adjustable to virtually any ergonomically desirable position. The peripheral support is preferably adapted to support virtually any type of peripheral, whether a writing pad or a book, or for supporting any type of electronic computing device, a display device, a communications device, or any type of user interface for such electronic devices. In the preferred embodiment of the present invention, the workstations is particularly adapted for peripherals such as laptop or portable computers which may be removably secured to the peripheral support and folded along with the articulating arm within the enclosure structure such that the peripheral is enclosed within the carrying case.

The portable workstation also preferably comprises first and second legs movable between a collapsed position and an extended position. In the preferred embodiment, the legs pivot with the respect to a vertical axis of the post between a folded position and an unfolded position when the enclosure structure is moved between the closed carrying case position and the open usable position. Also, preferably, a floor beam is operably connected to at least one of the first or second legs in order to provide additional lateral support when the workstation is in the open usable position.

In the preferred embodiment, the enclosure structure comprises two sets of opposing panel segments. The two adjacent side legs of the panel segments of the first set of panels are preferably attached to opposing sides of the preferred L-shaped arm bracket. With respect to the second set of opposing panel segments, one side leg of each panel segment is preferably attached to opposing sides of the post. The other side leg of each of the panel segments is preferably attached to the outwardly opposing sides of the legs. When the workstation is in the open useable position, the panel segments act as stiffening gussets. When the workstation is in the closed carrying case position, the panel segments are disposed to form a substantially rectangular carrying case with the two sets of opposing panel segments forming the side walls of the closed carrying case.

In an alternative embodiment, the enclosure structure comprises a collapsible panel preferably comprising first, second, third, fourth, fifth and sixth panel segments. In this alternative embodiment, the first and second panel segments are preferably movable with the first and second legs between their folded and unfolded positions. The fourth, fifth and sixth panel segments are preferably moveable with respect to at least one of the first and second panel segments to substantially enclose the articulating support structure when the portable workstation is in the closed carrying case position.

In yet another alternative embodiment, although the portable workstation remains collapsible into a carrying case, there are no panels comprising the enclosure structure.

To the accomplishment of the above objectives, features and advantages, this invention may be embodied in the forms illustrated in the accompanying drawings, attention being called to the fact, however, that the drawings are illustrative only, and that changes may be made in the specific form illustrated and described without materially departing from the teachings herein.

BRIEF DESCRIPTION OF DRAWINGS

FIG. 1 is a perspective view of one embodiment of the workstation of the present invention in an open useable position.

FIG. 2 is a perspective view of the embodiment of FIG. 1 in the closed carrying case position.

DETAILED DESCRIPTION

One embodiment of the portable workstation 10 of the present invention is shown in FIG. 1 in an open usable position, and in FIG. 2 in a closed carrying case position. The workstation 10 comprises an articulating support structure 12 and an enclosure structure 14 which cooperate between the open usable position and a closed carrying case position. When the workstation 10 is in the closed carrying case position (FIG. 2), the articulating support structure 12 is preferably substantially enclosed within the enclosure structure 14.

Figure 3:
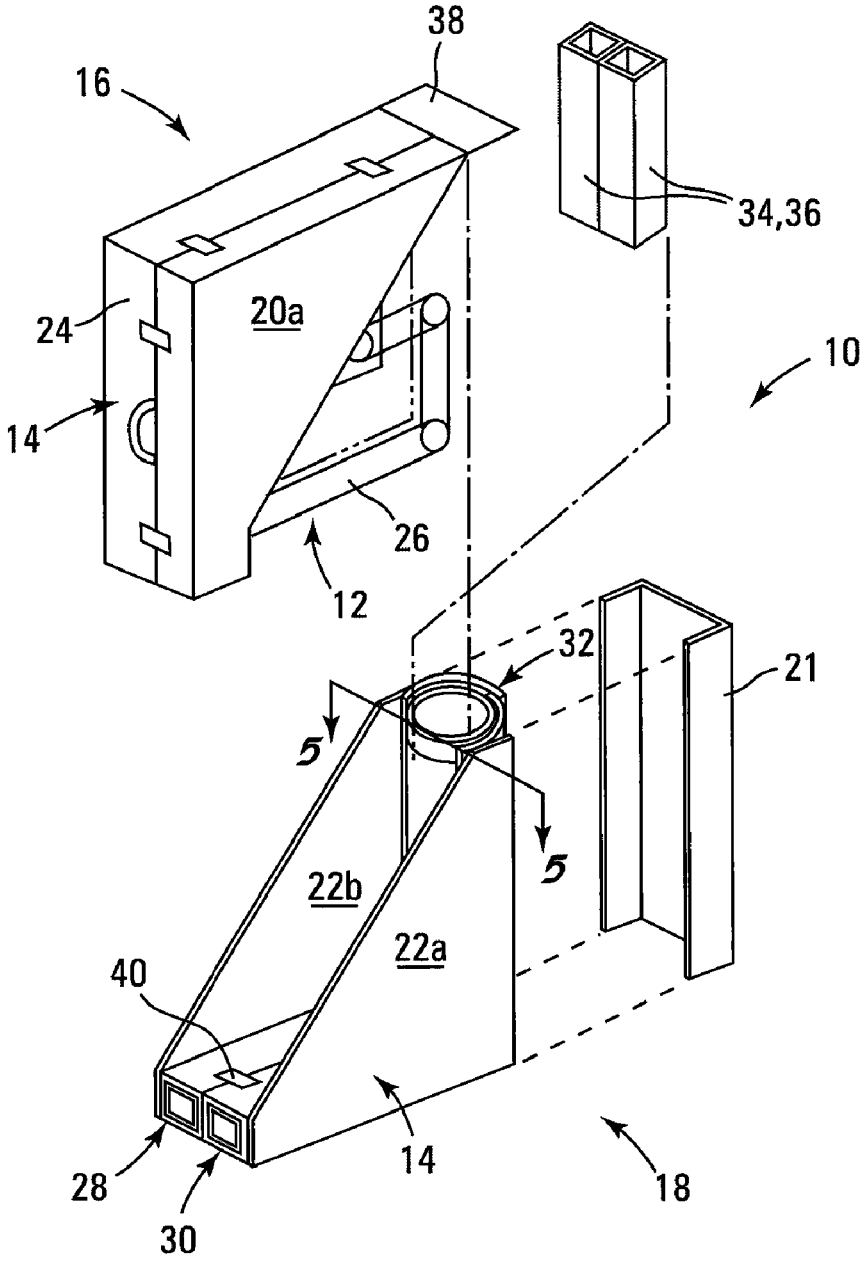
FIG. 3 is a perspective view of the embodiment of FIG. 1 illustrating the removal of a top assembly from a bottom assembly.

As best viewed in FIG. 3, the workstation 10 preferably comprises two assemblies 16, 18 that nest and releasably secure together by connecting means 19 to form the carrying case. The assemblies 16, 18 may be releasably secured together by any suitable connection means 19, including, for example, buckles, clips, clasps, snaps, hook and loop fasteners, ties, or any other releasable connecting means. Continuing to refer to FIG. 3, the first assembly 16 is preferably removable from the second assembly 18 upon releasing the connection means 19. The first assembly 16, preferably comprises one half of the enclosure structure 14, and the second assembly 18, preferably comprises the other half of the enclosure structure 14.

The enclosure structure 14, preferably comprises two sets of panels 20*a*, 20*b* and 22*a*, 22*b* and other structural members of the workstation 10 (as described in detail later) to which the panel sets are secured. The panels sets 20*a*, 20*b* and 22*a*, 22*b* and other structural members all preferably nest together to form opposing sidewalls and the perimeter of the rectangular carrying case as shown in FIGS. 2 and 3. A decorative facade 21 may be removably attachable to the case to cover the extendable post section described later. It should be appreciated that the enclosure structure 14, need not comprise the two sets of panels 20*a*, 20*b* and 22*a*, 22*b*. In which case the enclosure structure would simply comprise the structural members (described in detail later) of the portable workstation 10 which collapse and fold around the peripheral 100 (also described later).

Continuing to refer to FIG. 3 in combination with FIG. 1, the first assembly 16 preferably includes a portion of the articulating support structure 12, comprising an arm bracket 24 and a folded articulating arm 26. The second assembly 18 preferably includes a telescoping post 32, also forming a part of the articulating support structure 12, as well as a pair of telescoping legs 28, 30. Each of the telescoping legs 28, 30 preferably comprises telescoping leg segments 28*a*, 28*b*, 28*c* and 30*a*, 30*b*, 30*c*. Additionally, the extendable post 32 preferably comprises telescoping post segments 32*a*, 32*b*. A pair of telescoping floor beams 34, 36 are also preferably secured to the legs 28, 30 to provide additional lateral support as described later.

Figure 5:
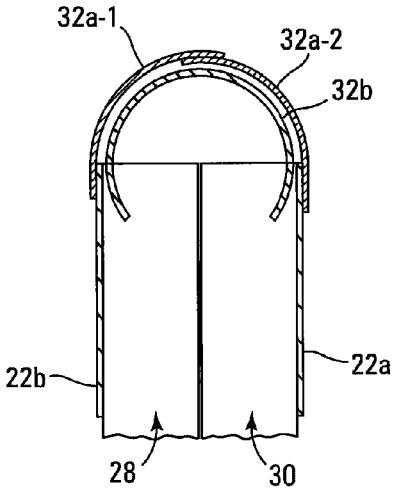
FIG. 5 is a cross-sectional view of the bottom assembly as viewed along lines 5—5 of FIG. 3.
Figure 6:
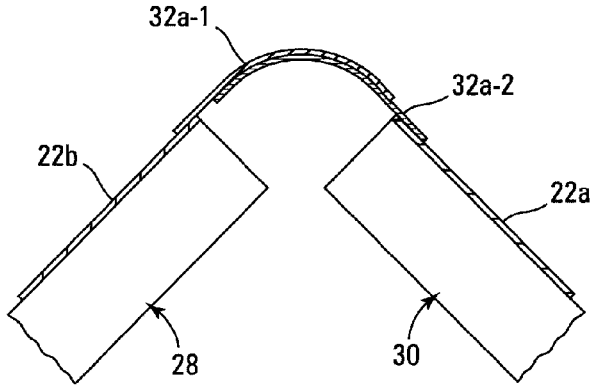
FIG. 6 is a cross-sectional view of the of the bottom assembly as viewed along lines 6—6 of FIG. 1.

The second assembly 18 preferably unfolds upon releasing a second connection means 40, which releasably connects the legs 28, 30. The legs 28, 30 preferably pivot about the vertical axis of the telescoping post 32 from the closed position to the open usable position. To enable the legs 28, 30 to pivot about the vertical axis of the post 32, the first post segment preferably comprises two hinged arcuate sections 32*a*-1, 32*a*-2 which rotate with respect to one another about the central axis of the post 32. The two arcuate sections 32*a*-1, 32*a*-2 may be movably connected as by tongue and groove arrangement, or alternatively, as shown in FIGS. 5 and 6, two arcuate sections 32*a*-1, 32*a*-2 may rotate with respect to one another in an overlapping relationship. As best viewed in FIGS. 5 and 6, one of the panels 22*a* of the enclosure structure 14 of the assembly 18 is fixed along one side to one arcuate section 32*a*-1 and to the side of the adjacent leg 28. The other panel 22*b* is fixed along one side to the other arcuate section 32*a*-2 and to the side of the adjacent leg 30. It should be appreciated, that when the assembly 18, is in the open position, the panels 22*a*, 22*b* act as gussets to add structural rigidity between the post 32 and the legs 28, 30. As best viewed in FIGS. 1 and 5, the post segment 32*b* includes a slot or cut-out 33 which provides additional interior space within the enclosure structure 14 when the workstation is in the closed carrying case position for storing the extendable floor beams 34, 36 and other items such as a power cord, etc. (See FIG. 13).

Figure 4:
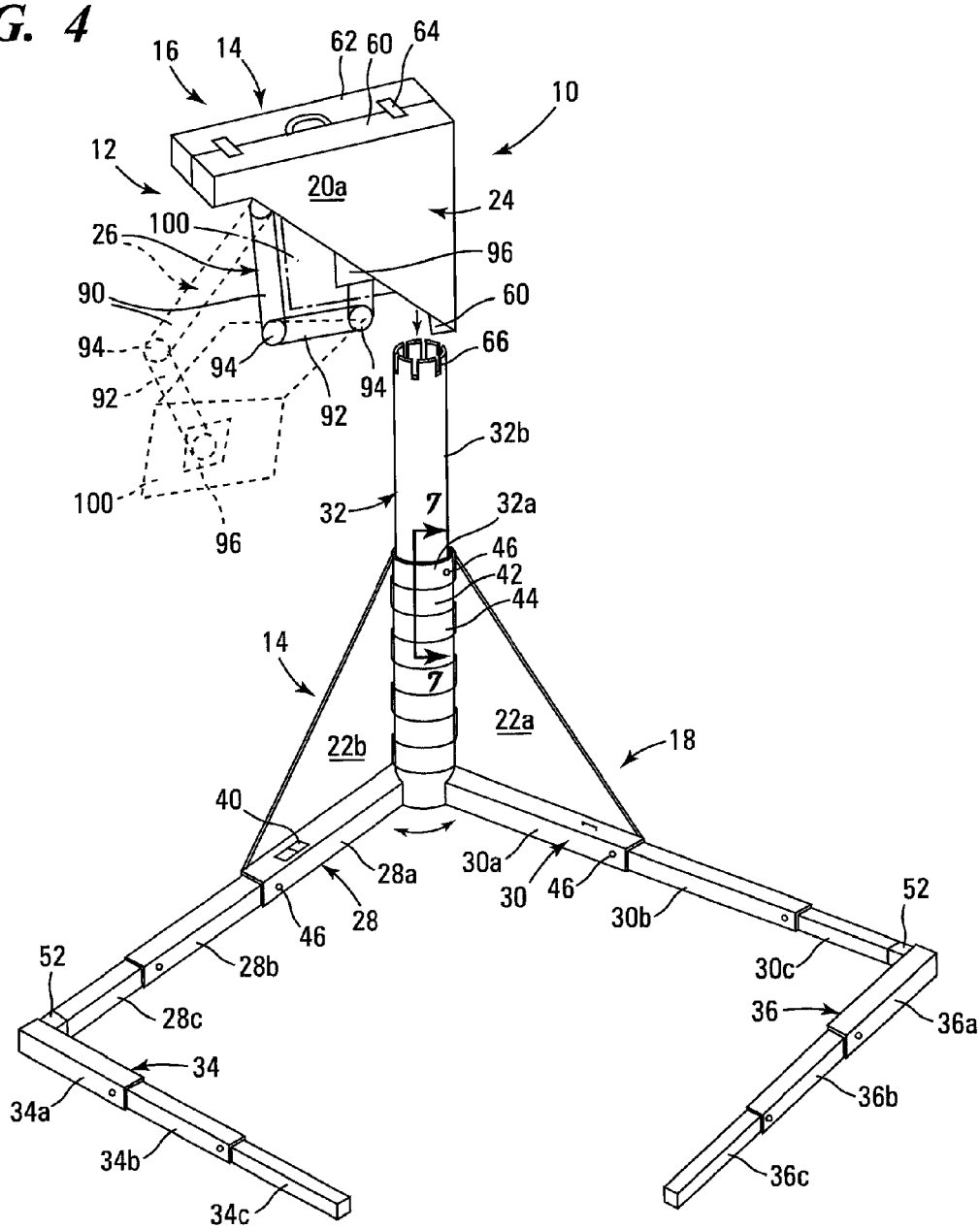
FIG. 4 is a perspective view of another embodiment of the workstation of the present invention in an open useable position having an alternative post and hinge arrangement.

FIG. 4 is shows an alternative post/hinge arrangement. In this embodiment, the first post segment 32*a* is cylindrical and does not rotate. Rather, a plurality of collars 42, 44 are rotatably disposed around the first post segment 32*a*, much like a common door hinge. As best viewed in FIG. 7, one of the panels 22*a* of the enclosure structure 14 of the assembly 18 is fixed along one side to every other collar 42. The other panel 22*b* is fixed along one side to the other collars 44. Thus, the panels 22*a*, 22*b* and the respective adjacent legs 28, 30 fixed thereto are pivotable with respect to one another about the vertical axis of the post 32 while the first post segment 32*a* remains stationary. As in the other embodiments, when the assembly 18, is in the open position, the panels 22*a*, 22*b* act as gussets to add structural rigidity between the post 32 and the legs 28, 30. The floor beams 34, 36 and other accessories, such as power cords, etc., can be stored within the telescoping post segments 32*a*, 32*b* when the workstation is in the closed carrying case position.

Figure 7:
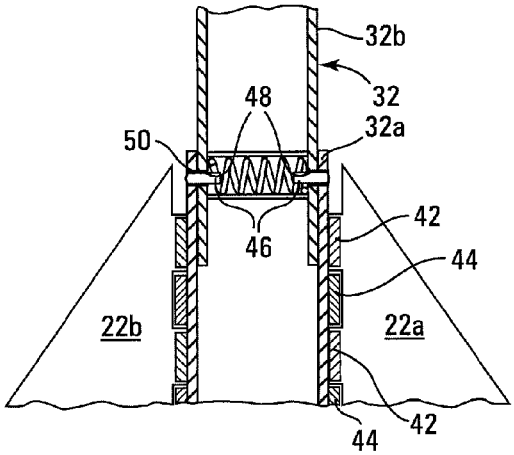
FIG. 7 is a cross-sectional view of the bottom assembly as viewed along lines 7—7 of FIG. 4 showing the preferred locking means for the extendable post.

Once the bottom assembly 18 is unfolded, the legs 28, 30 and the post 32 may be extended and are preferably lockable into position. FIG. 7 illustrates the preferred means for interlocking the telescoping post segments in the extended position using spring biased pegs 46 that extend through apertures 48 in the side walls of the post segment 32*b*, and into mating apertures 50 in the succeeding outwardly adjacent post segment 32*a*. To collapse the post 32, the spring biased pegs 46 are pushed inwardly thereby allowing the inner post segment 32*b* to slide downwardly in telescoping relation within succeeding outwardly adjacent post segment 32*a*. The legs 28, 30 and floor beams 34, 36 also preferably lock into their respective extended positions using the same interlocking means.

Figure 8:
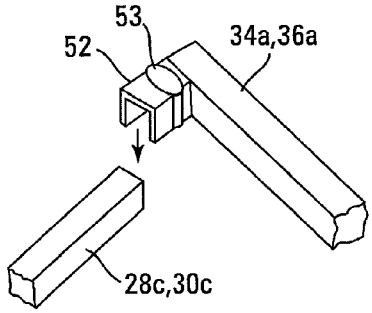
FIG. 8 is a partial perspective view of the of the preferred leg and floor beam connection for the portable workstation embodiments of FIGS. 1 and 4 of the present invention.

As shown in FIG. 8, the floor beams 34, 36 preferably releasably connect to the distal ends of the extended legs 28, 30 by means of a U-shaped channels 52 secured proximate the ends of the floor beam segments 34*a*, 36*a*. The U-shaped channels 52 preferably frictionally receive the ends of the extended leg segments 28*c*, 30*c*. The use of the floor beams 34, 36 add lateral stability when the legs 28, 30 are opened, particularly when the legs are opened to an angle greater than ninety degrees. It may be desirable to enable the floor beams 34, 36 to be angularly movable with respect to the legs 28, 30 for additional lateral stability or due to space constraints. Accordingly, as shown in FIG. 8, the U-shaped channels 52 preferably include a hinge or pin 53 to enable the floor beams 34, 36 to pivot angularly with respect to the legs 28, 30.

It should be appreciated that various embodiments for providing the functionality of extending, collapsing and locking the post, legs, and floor beams may be utilized, and therefore the present invention should not be construed as limited to any particular shape for the posts, legs and floor beams or to any particular interlocking means. For example, the shape of the telescoping post, leg and floor beam segments may be any geometric shape, including square, rectangular, hexagonal, etc. Additionally, it should be appreciated that there are numerous suitable means which may be used for interlocking the telescoping segments. For example, slightly ob-round segments may be provided, whereby twisting one ob-round segment with respect to the other ob-round segment frictionally interlocks the segments. Still another means for interlocking the telescoping segments may include simply inserting dowels through matingly aligned apertures in adjacent segments. Additionally, rather than interlocking the telescoping segments, the segments might be spring biased, frictionally fit, pneumatically biased, or utilize any other conventional means known to those skilled in the art for enabling telescoping segments to be releasably maintained in an extended position until it is desired to collapse the telescoping segments into a collapsed position. Furthermore, it should be appreciated that rather than telescoping segments, the segments may be hinged at their ends so as to fold instead of telescope, such as disclosed in U.S Pat. No. 6,076,787, for example. Still another example might include using an embodiment similar to that commonly used in tent poles in which one end of the segment is flared to receive the adjacent segment. This type of embodiment might further include an elastomeric cord disposed through the center of the segments to bias the segments together.

Figure 9:
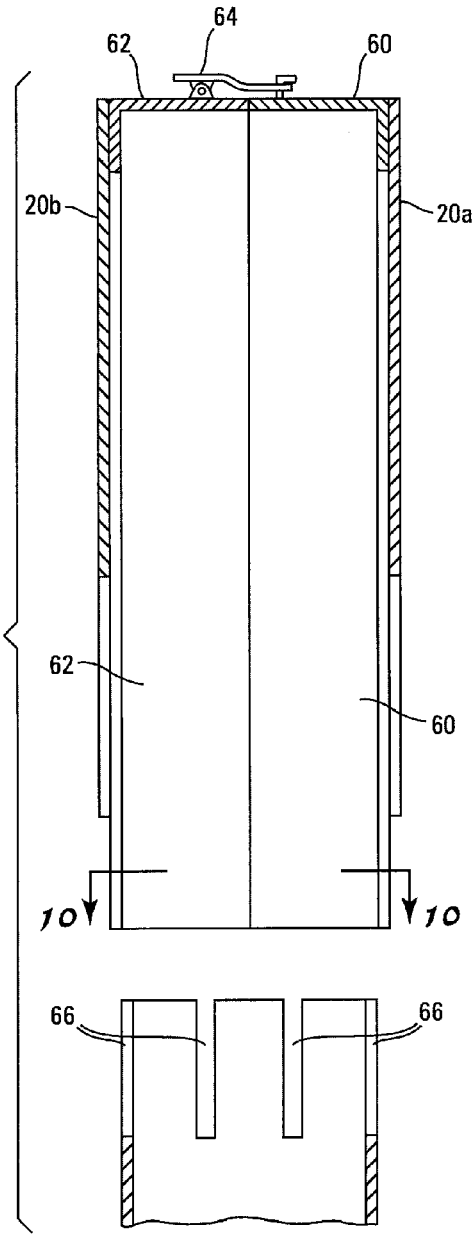
FIG. 9 is a partial cross-sectional view of the preferred arm bracket as viewed along lines 9—9 of FIGS. 1 and 4.

Referring again to FIGS. 1 and 4, as identified above, the first assembly 16 of the preferred embodiment, includes the articulating support structure 12, comprising an arm bracket 24 and a foldable articulating arm 26. The arm bracket 24 is preferably comprised of two opposing L-shaped members 60, 62. Panels 20*a*, 20*b* are preferably fixed to the opposing sides of the L-shaped members 60, 62. With the workstation in the open useable position, the panels 20*a*, 20*b* act as gussets to the L-shaped members 60, 62 to more rigidly support the articulating arm 26 in an extended position. For purposes described in detail later, the L-shaped members 60, 62 are preferably releasably connected together by connecting means 64 (such as buckles, snaps or the like, as previously discussed). As best viewed in FIG. 9, which is a cross sectional view of the assembly 16 as viewed along lines 10—10 of FIGS. 1 and 4, the L-shaped members 60, 62 are preferably fabricated from standard angles, such as 2×2 or 2×3 angles or larger. As shown in FIG. 9, when the two legs of the angles are placed together they form a channel that is preferably four inches deep or greater. Although the L-shaped members 60, 62 may be fabricated from various shaped members such as square or rectangular tubing, for example, it should be appreciated that by using angles to form a channel, additional usable area is created within the interior of the enclosure structure 14 for greater storage that would otherwise be unnecessarily lost by using square or rectangular tubing.

Figure 10:
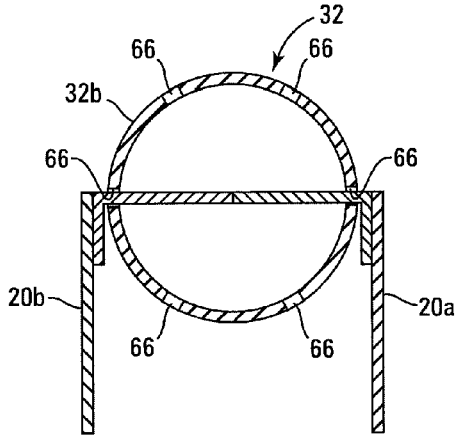
FIG. 10 is a cross-sectional view showing the top assembly received by slots in the top post segments as viewed along lines 10—10 of FIG. 9.

Referring again to FIGS. 1 and 4, after the bottom assembly 18 is unfolded and the legs and post are extended and locked in place as previously discussed, the top assembly 16 is placed on top of the upper post segment 32*b*. The lower ends of the L-shaped members 60, 62 are received within slots 66 in the top of the post segment 32*b* as shown in FIG. 10 as viewed along lines 10—10 of FIG. 9, thereby securing the top assembly 16 to the post 32. With the top assembly 16 secured to the extended post 32, the articulating arm 26 may be unfolded.

Figure 18:
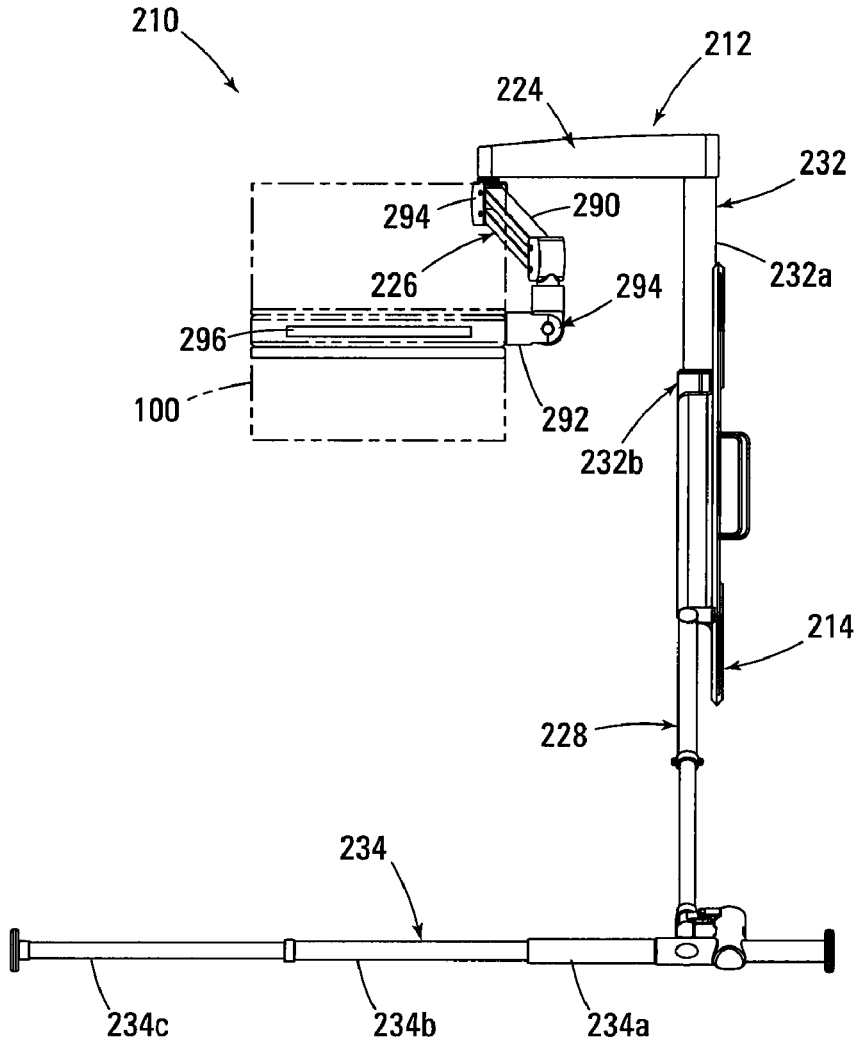
FIG. 18 is a front elevation view of the FIG. 15 embodiment of the workstation of the present invention with the articulating support structure in an extended position.
Figure 20:
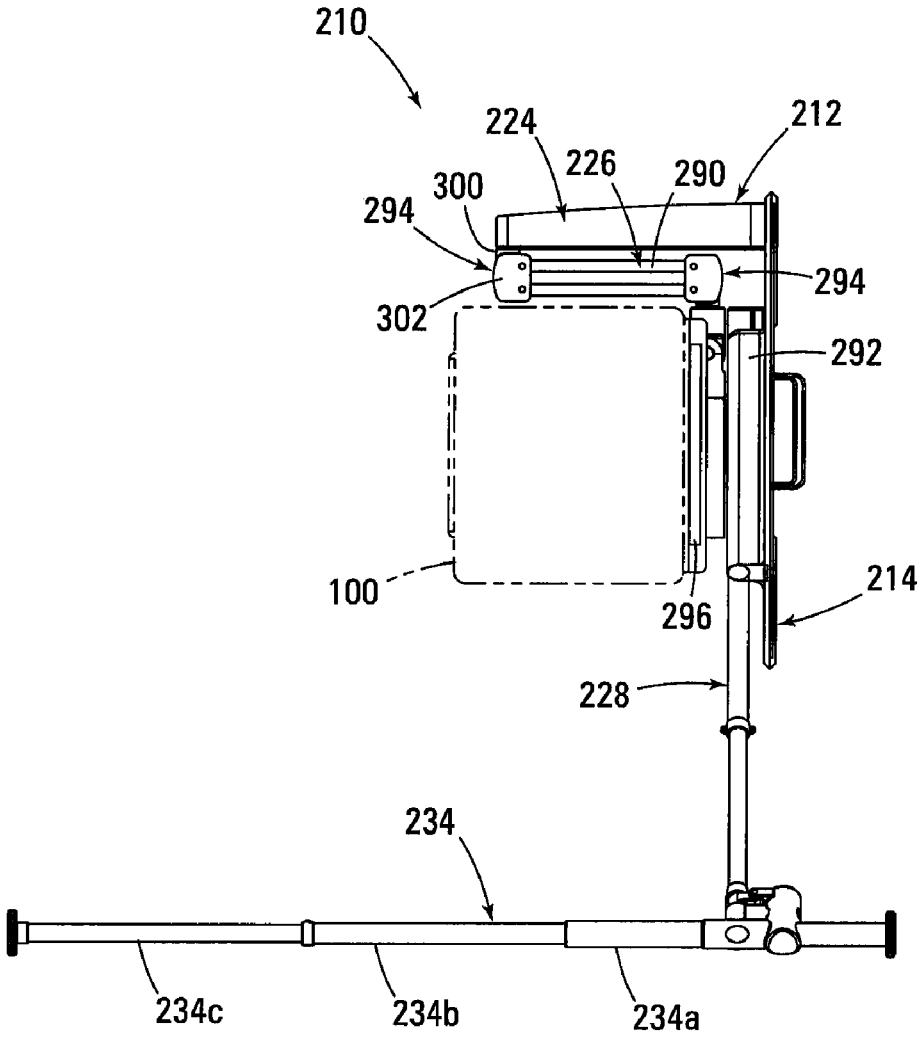
FIG. 20 is a perspective view of the FIG. 15 embodiment of the workstation of the present invention showing the floor beam in the collapsed position.

As best illustrated in FIGS. 1 and 4, the articulating arm 26 preferably comprises first arm segment 90 and a second arm segment 92. Universal joints 94 preferably connect the first arm segment 90 to the arm bracket 24 and the second arm segment 92 to the distal end of the first arm segment 90. An additional universal joint 94 on the distal end of the second arm segment 92 also preferably connects a peripheral support 96 thereto. As used in this specification, the term "universal joint" should be understood as meaning a single joint (such as a ball joint, for example, as shown in U.S. Pat. No. 5,769,369) or a combination of joints (for example, as shown in FIGS. 18 and 20 discussed later) which enables both horizontal and vertical rotation of an arm segment. For example, one joint of the combination may provide only horizontal rotation of the arm segment and another joint may provide vertical rotation of the arm segment, but the two in combination enable both horizontal and vertical rotation of the arm segment. Therefore, it should be appreciated that the articulating arm 26 is movable with respect to the post 32 such that the peripheral support 96 at the distal end of the articulating arm 26 is movable horizontally and vertically in any direction to virtually any desired position. Based on the foregoing, it should be understood that each universal joint may have an infinite number of axis. Thus, if multiple arm segments are joined by universal joints, then the resulting articulating arm 26 will necessarily have at least two non-intersecting axis. For example, referring to FIG. 1, and for illustration purposes only, the peripheral support may be movable about axis A—A as indicated by the arrow, as well as about axis B—B and about axis C—C, each of which are non-intersecting.

Figure 11:
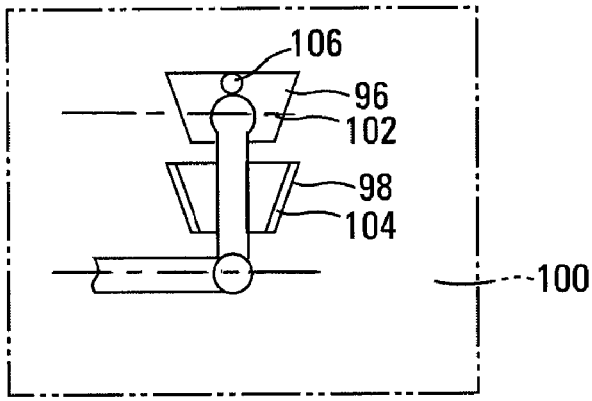
FIG. 11 is an elevation view showing the preferred quick-release connector for the peripheral support of the workstation of the present invention.

The peripheral support 96 may be a substantially planar surface for supporting any type of peripheral 100, such as a writing pad or book, for example, or for supporting any type of electronic computing devices, display devices, communications devices, or any type of user interface for such electronic devices. In the preferred embodiment, the workstation 10 is particularly adapted for peripherals 100 such as laptop or portable computers which may be removably secured to the peripheral support 96 and folded along with the articulating arm 26 within the enclosure structure 14 such that the peripheral 100 accompanies the workstation 10 within the carrying case. In this preferred embodiment, the peripheral support 96 comprises a quick-release connector 98 as illustrated in FIG. 11. The quick-release connector 98 preferably comprises a trapezoidal shaped plate 102 which is received within a mating trapezoidal shaped frame 104 removably secured to the peripheral 100. Set screws 106, or any other type of releasable connector, removably secures the plate 102 within the frame 104.

Figure 12:
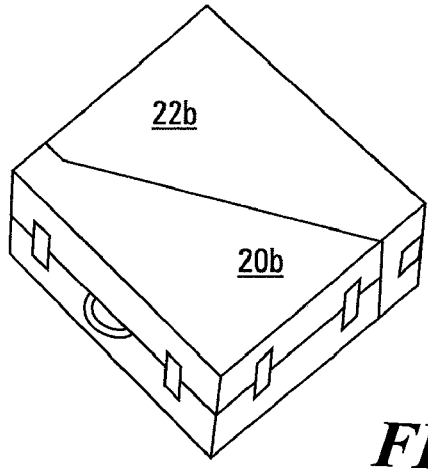
FIG. 12 is a perspective view of the portable workstation embodiments of FIGS. 1 and 4 in the closed carrying case position laying horizontally.
Figure 13:
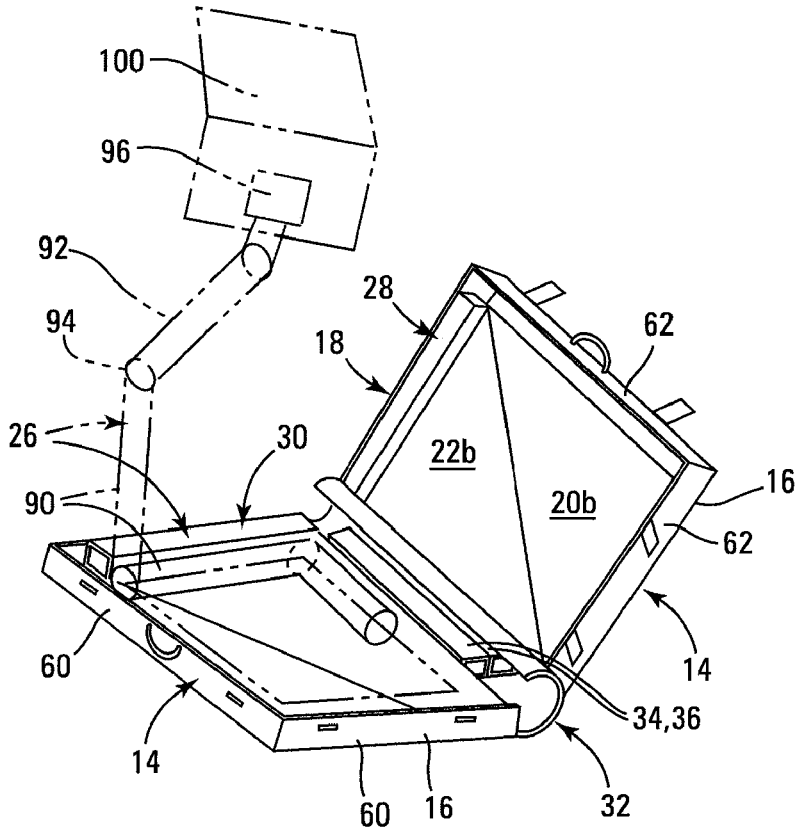
FIG. 13 is a perspective view of the portable workstation embodiment of FIG. 12 in another open usable position.

Referring now to FIGS. 12 and 13, the enclosure structure 14 forming the carrying case is also preferably openable from the end of the carrying case opposite the post 32 to allow the articulating support structure 12 to be unfolded to gain access to the peripheral 100 stored therein without having to completely remove the assemblies 16, 18 from one another and without having to extending the post 32 and the legs 28, 30. This feature is particularly beneficial when it is desired to use the workstation 10 in confined spaces such as airplanes and automobiles where it may not be possible or desirable to extend the post 32 and legs 28, 30 to create a vertically disposed stand as shown in FIGS. 1, 4 and 7. As shown in FIGS. 12 and 13, the user can simply lay the carrying case down such that the panels 20*a*, 22*a* of the enclosure structure 14 are facing down and resting on the user's lap, on a table or other support surface. By releasing the connection means 64 that connects the L-shaped members 60, 62 as previously identified, the enclosure structure 14 is allowed to open. The universal joints 94 of the articulating support structure 12 enable the articulating arm segments 90, 92 thereof to be raised and rotated so as to be able to use the peripheral support 96 and/or the peripheral 100 secured thereto in an ergonomically desired position.

Figure 14:
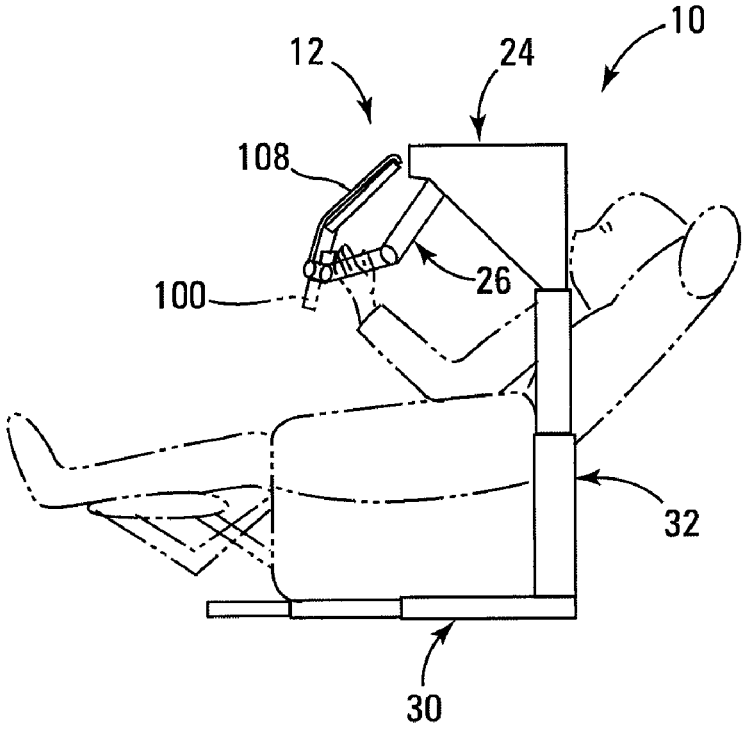
FIG. 14 is a side elevation view showing an embodiment of the portable workstation of the present invention in use with a user in a substantially reclined position.

Due to the universal joints 94 and the multi-segmented articulating arm 26, the user may place the peripheral support 96 in virtually any desired ergonomic position, including, for example, as shown in FIG. 14, the peripheral 100 may be placed in a substantially inverted position for use while the user is in a substantially reclined position. Such a position may be desirable among users who, for example, spend hours in front of computers writing code or playing video games, or for users who simply desire to work, read or write in a substantially reclined position for comfort or for other ergonomic considerations. It should be appreciated that, depending on the peripheral 100 and its manner of support or connection (if any) to the peripheral support 96, it may be desirable to provide additional accessories to retain the peripheral 100 on the peripheral support 96. For example, if the peripheral 100 is a laptop computer as shown in FIG. 14, it may be desirable to provide an accessory 108, such as a bracket, an elastic cord, or the like to retain the monitor at the desired angle and to prevent it from closing under its own weight when the laptop is in a substantially inverted position as shown. Similarly, if the peripheral is a book or writing pad, it may be desirable to provide such an accessory 108 to retain the book or writing pad on the platform without the user having to hold the peripheral 100 onto the peripheral support 96. Various types of such accessories 108 are shown in U.S. Pat. Nos. 4,496,126; 4,978,096; 5,709,365; 5,729,465; 5,979,857 the disclosures of which are incorporated herein by reference.

It should be appreciated that the FIG. 4 embodiment which utilizes the stationary post/collar hinge arrangement is also capable of opening as from the end as shown in FIGS. 12 and 13. Particularly with respect to the post/collar hinge arrangement of FIG. 4, the two halves of the case may open with respect to one another nearly a full 360 degrees such that the two ends 60, 62 may rest on a table or other support surface thereby forming an "A" with the articulating support structure 12 extending therefrom. Alternatively, the case may be hung over a cubicle wall partition, for example, such that one half of the case is on one side of the partition wall and the other half of the case is on the other side of the partition wall with the articulating support structure extending from the open case.

Figure 16:
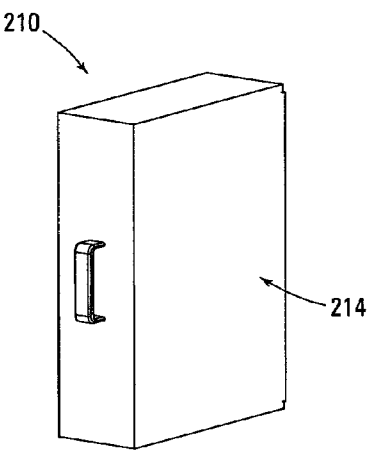
FIG. 16 is a perspective view of the FIG. 15 embodiment of the workstation of the present invention in the closed carrying case position.
Figure 15:
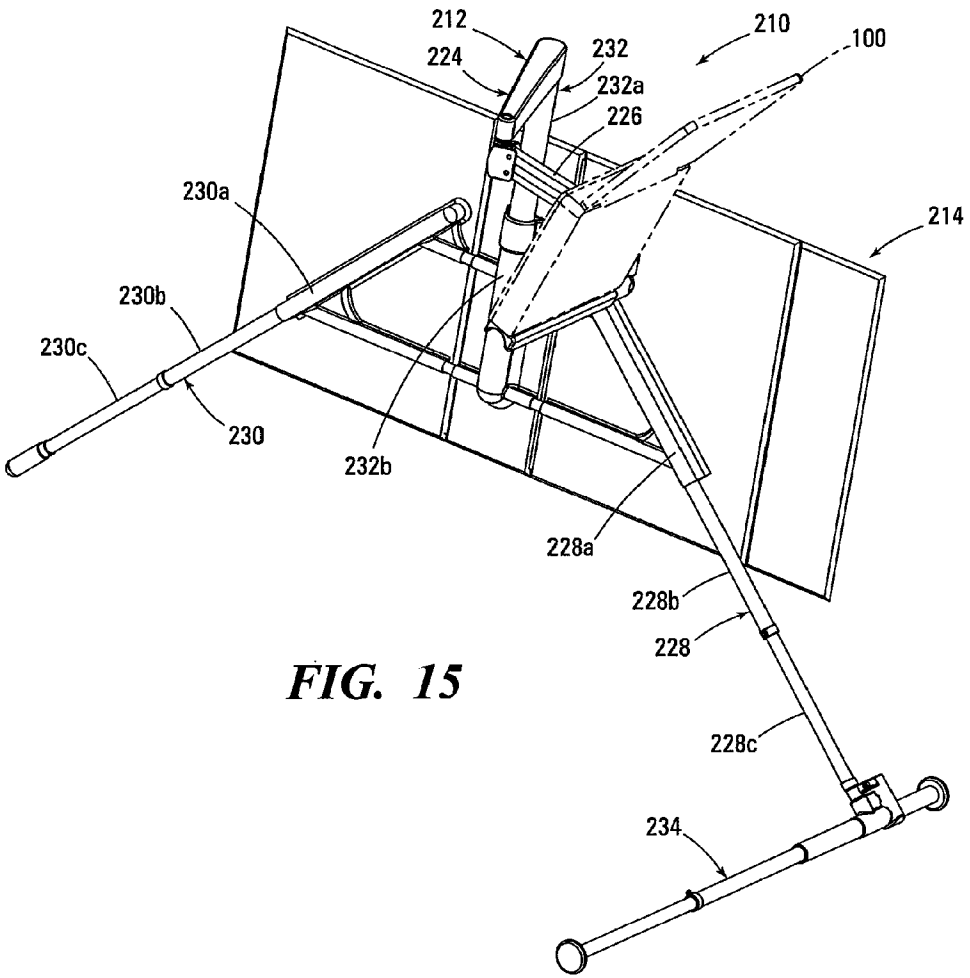
FIG. 15 is a perspective view of another embodiment of the workstation of the present invention in an open useable position.

Yet another alternative embodiment of the portable workstation of the present invention is shown in FIGS. 15 and 16 in the open usable position and in the closed carrying case position, respectively. Similar to the preferred embodiment of the works station 10 illustrated in FIGS. 1–14, this alternative workstation embodiment 210, is comprised of an articulating support structure 212 and an enclosure structure 214 which cooperate between the open usable position and the closed carrying case position. When the workstation 210 is in the closed carrying case positions (FIG. 16), the articulating support structure 212 is preferably substantially enclosed within the enclosure structure 214.

Referring to FIG. 15, similar to the previous embodiment, the articulating support structure 212, comprising an arm bracket 224 and a folded articulating arm 226. Also, similar to the previous embodiment, the workstation 210 includes a pair of telescoping legs 228, 230 and a telescoping post 232. Each of the telescoping legs 228, 230 preferably comprises telescoping leg segments 228*a*, 228*b*, 228*c* and 230*a*, 230*b*, 230*c*. Additionally, the telescoping post 232 preferably comprises telescoping post segments 232*a*, 232*b*. At least one of the legs 228, 230 preferably includes a telescoping floor beam 234 which is preferably pivotally connected thereto (described later) to provide additional lateral support to the workstation 210 to prevent it from tipping. The floor beams 234 preferably comprise telescoping floor beam segments 234*a*, 234*b*, 234*c*.

Figure 17:
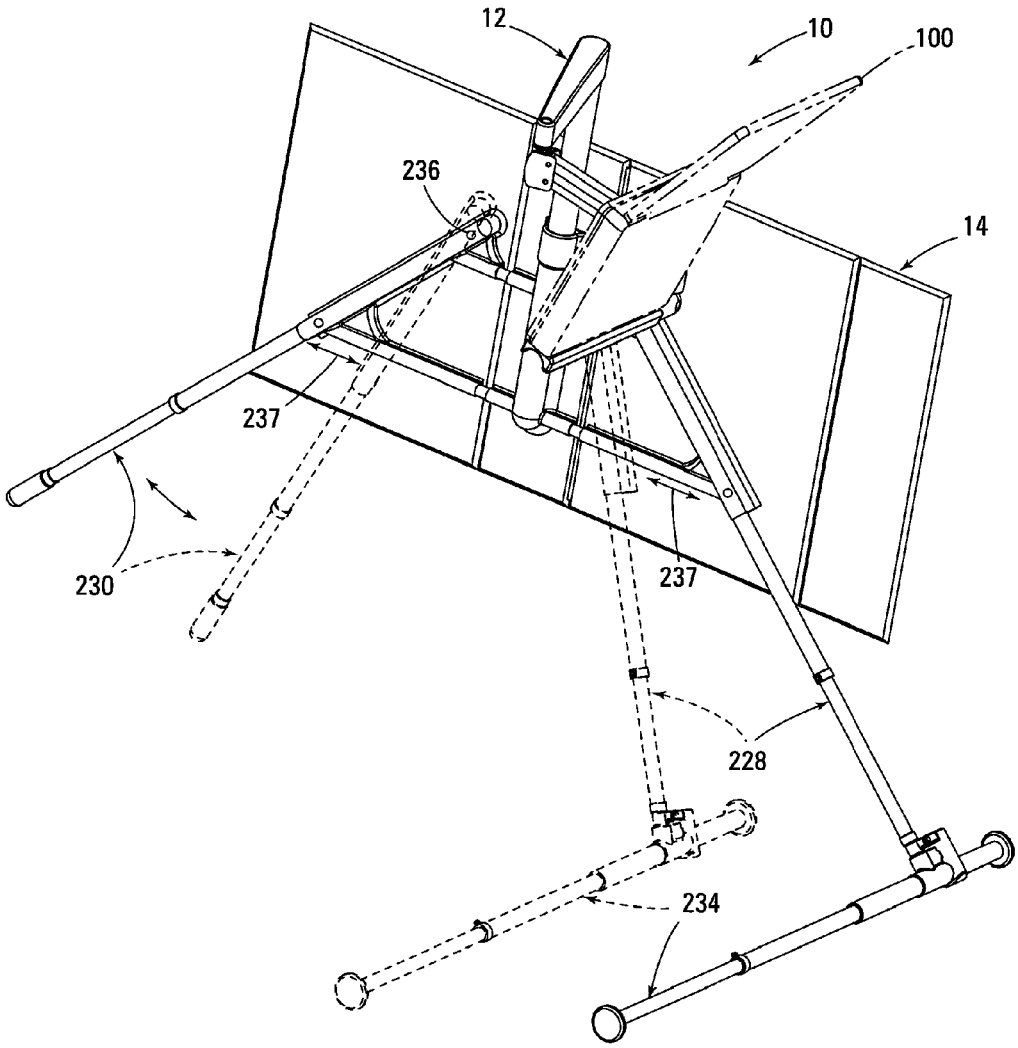
FIG. 17 is a perspective view of the FIG. 15 embodiment of the workstation of the present invention in which the legs are movable to provide additional vertical height adjustment.

As an alternative embodiment, in order to enable additional vertical height adjustment, the legs 228, 230, may be movable as shown in FIG. 17. In this alternative embodiment, the upper leg segments 228*a*, 230*a* may be pinned at their upper ends as indicated by pin 236 and the lower ends of the upper leg segments 228*a*, 230*a*, may slide horizontally as indicated by arrow 237. Those skilled in the art will appreciate that various other embodiments for allowing the legs 228, 230 to move to enable additional vertical height adjustment may also be used, and therefore the present invention should not be construed as being limited to the specific examples provided.

Figure 19:
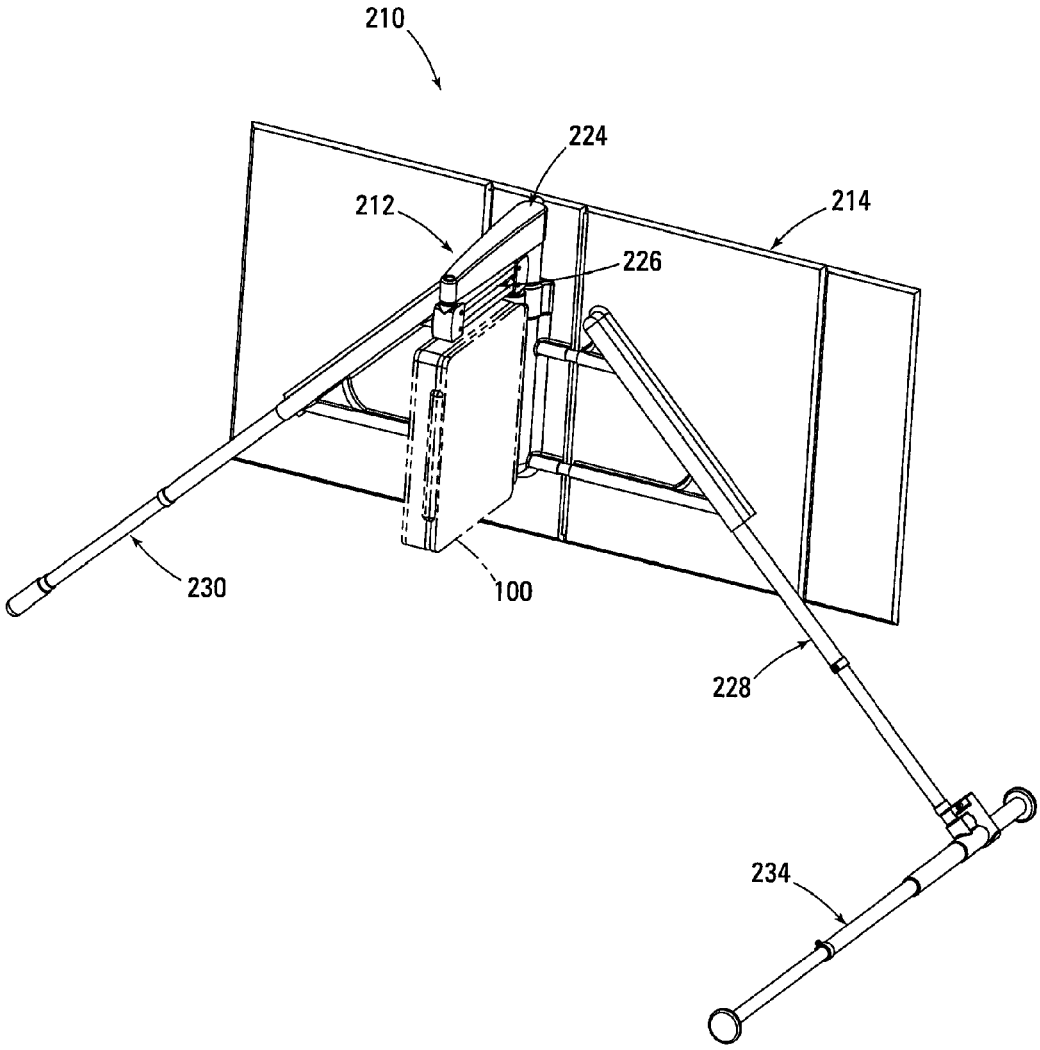
FIG. 19 is a front elevation view of the FIG. 115 embodiment of the workstation of the present invention with the articulating support structure in the collapsed position.

Referring to FIGS. 18 and 19, the articulating support structure 212, comprises an arm bracket 224 and a foldable articulating arm 226. The arm bracket 224 is preferably rotatably connected to the post 232. The articulating arm 226 preferably comprises first arm segment 290 and a second arm segment 292. A universal joint 294 preferably connects the first arm segment 290 to the arm bracket 224. A second universal joint 294 preferably connects the distal end of the first arm segment 290 to the second arm segment 292. As best shown in FIGS. 18 and 20, for example, the universal joint 294 may comprising two separate joints which cooperate to provide both horizontal and vertical rotation or pivoting. Horizontal rotation is provided by a pin 300, about which sleeve 302 rotates and vertical movement of the first arm segment 290 is enabled by four-point pivot or parallelogram construction of the arm segment 290. It should be appreciated that the articulating arm 226 through the combination of joints 294 enable the peripheral support 296 to be movable both horizontally and vertically to virtually any desired position.

As with the previous embodiment, the peripheral support 296 may be a substantially planar surface for supporting any type of peripheral 100, such as a writing pad for example, or any type of electronic computing devices, display devices, communications devices, or any type of user interface for such electronic devices. Also, as with the previous embodiment, the workstation 210 is particularly adapted for peripherals 100 such as laptop or portable computers which may be removably secured to the peripheral support 296 and folded along with the articulating arm 226 within the enclosure structure 214 such that the peripheral 100 accompanies the workstation 210 within the carrying case. The peripheral support 296 preferably comprises a quick-release connector such as the type previously discussed with reference to FIG. 11, or alternatively, as in the present embodiment, the quick release connector may comprise a conventional channel removably attached to peripheral which releasably receives a mating bar extending from the second arm segment 292 which slides therein. This slidable connection allows the peripheral support 296 to move slidably with respect to the second arm segment 292.

With reference to FIGS. 18–26, in combination with the following description, it will be appreciated how the elements comprising the workstation 210 collapse and/or fold with respect to one another into the closed carrying case position as shown in FIG. 16. First, comparing FIG. 19 with FIG. 18, the articulating arm 226 with the peripheral 100 attached thereto is folded as shown such that the arm 226 and peripheral 100 are substantially perpendicular to the post 232.

Second, comparing FIGS. 18 and 19, the post 232 is collapsed by releasing interlocking means (not shown), such as by depressing spring loaded pegs as previously described, thereby allowing the second post segment 232*b* to move slidably in telescoping relation within the first post segment 232*a*. It should be appreciated, that as previously identified any desired means for interlocking the post segments may be used and that the present invention should not be construed as limited to any particular interlocking means. Furthermore, also as identified with respect to the previous embodiment, the means of collapsing the post should not be construed as limited to telescoping post segments.

Figure 21:
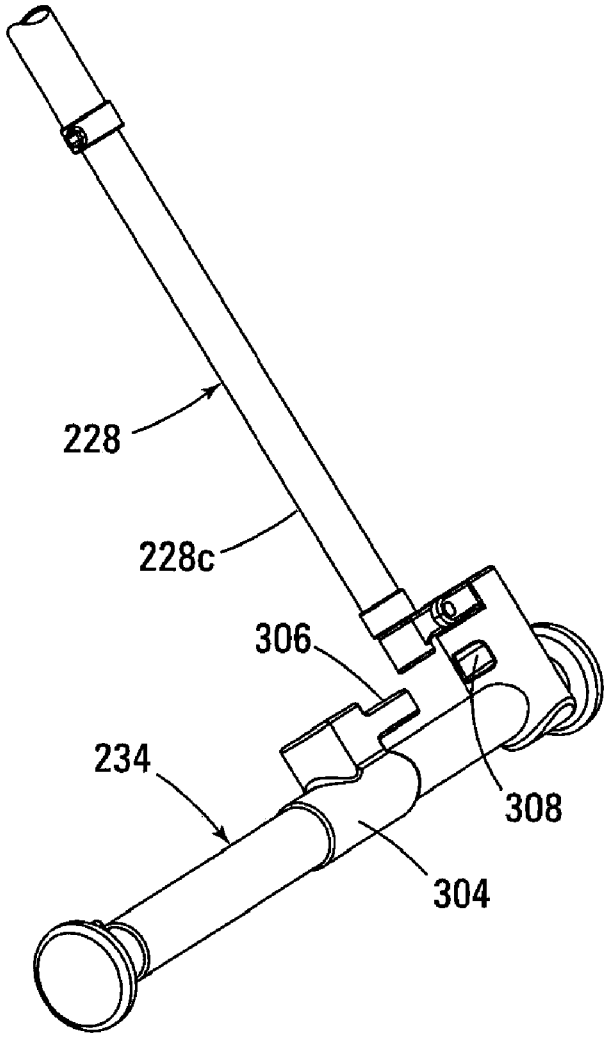
FIG. 21 is a detailed perspective view of the FIG. 15 embodiment of the workstation of the present invention showing the slidable lock for the floor beam.
Figure 22:
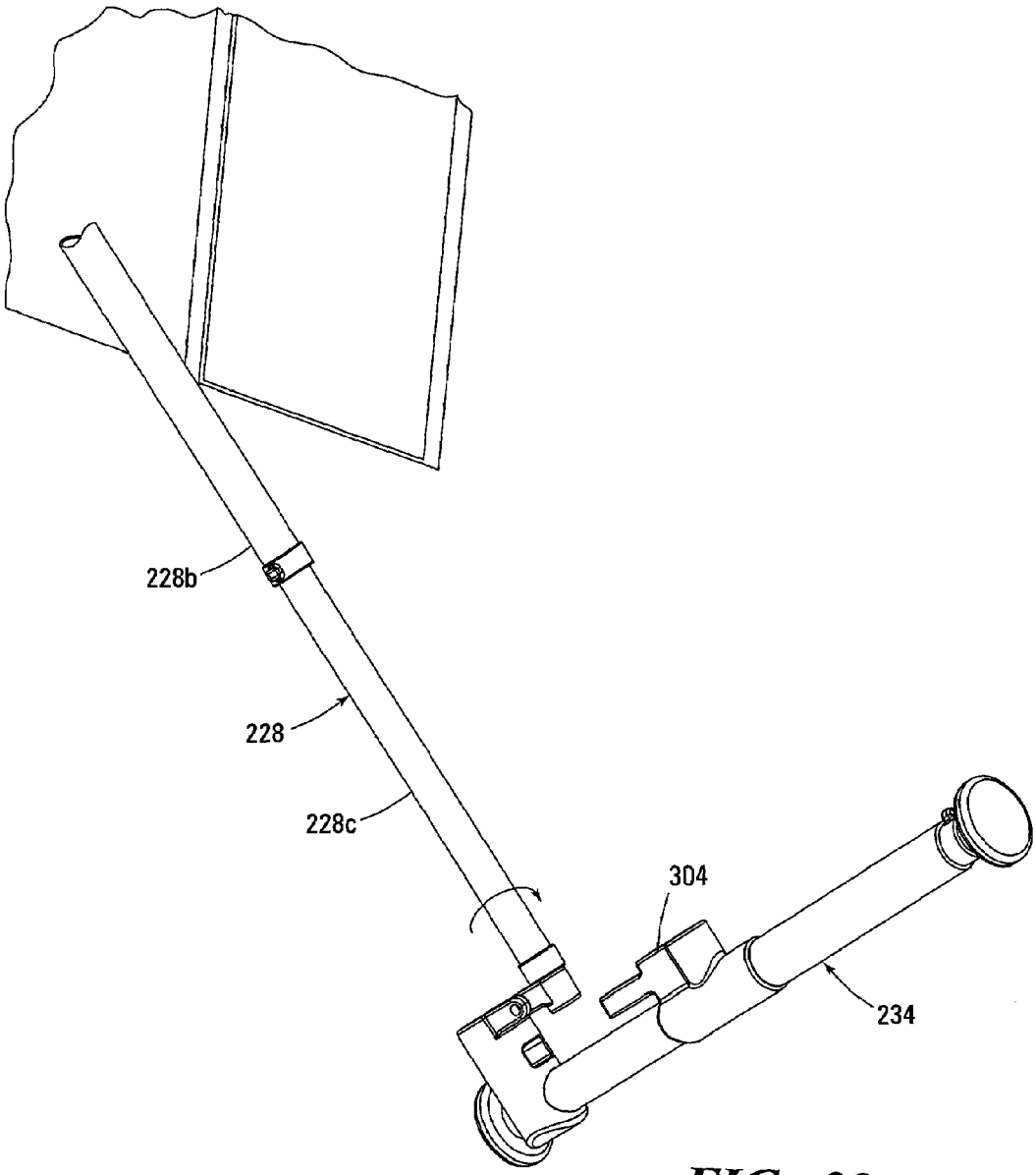
FIGS. 22 and 23 are detailed perspective views of the FIG. 15 embodiment of the workstation of the present invention showing the method of folding the preferred floor beam.
Figure 23:
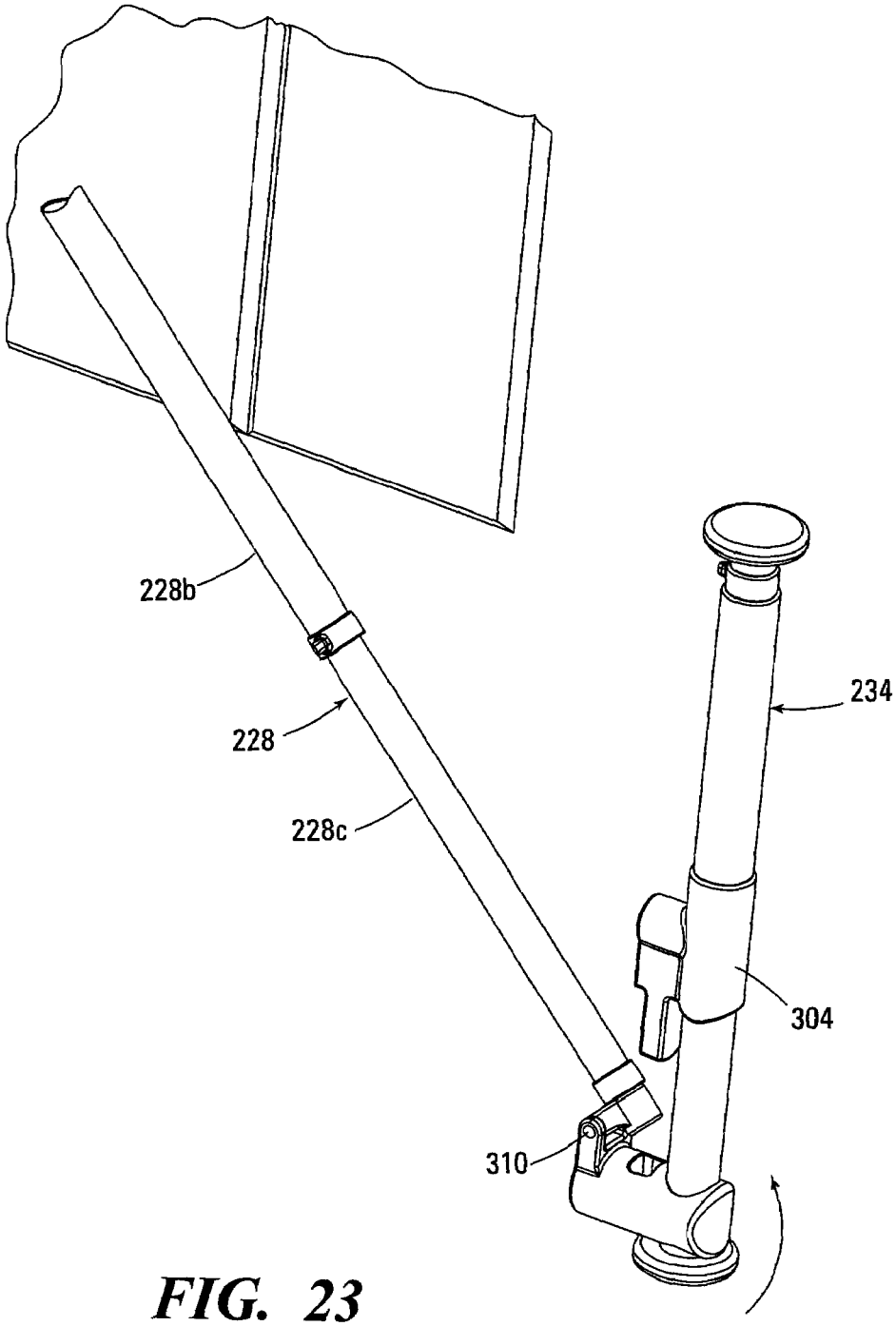

Third, comparing FIGS. 19 and 21, the floor beam 234 is collapsed from its extended position. Fourth, comparing FIGS. 21 and 22, the floor beam 234 is rotated about the leg 228 by releasing a slidable lock 304 which disengages peg 306 from receptacle 308. Fifth, comparing FIGS. 22 and 23, the floor beam is then folded by rotating the floor beam 234 about pin 310 such that it is substantially vertical. Sixth, comparing FIGS. 19 and 24, the legs 228 and 230 are collapsed. As with the post 232, the legs 228, 230 and the floor beam 234 preferably include spring biased pegs which interlock the telescoping segments. However, also as with the post 232, it should be appreciated, that any desired means for interlocking the segments may be used and that the present invention should not be construed as limited to any particular interlocking means. Furthermore, also as identified with respect to the previous embodiment, the present invention should not be construed as limited to the use of telescoping segments only.

Figure 24:
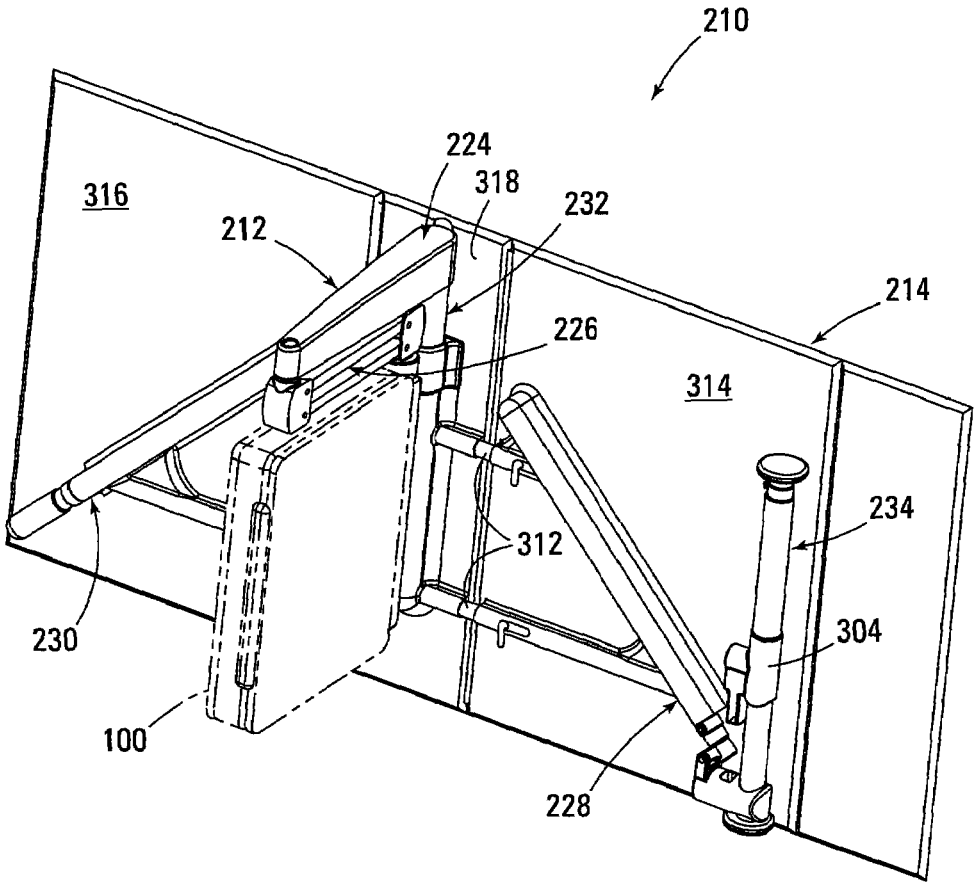
FIG. 24 is a perspective view of the FIG. 15 embodiment of the workstation of the present invention showing the legs, floor beam and articulating support structure collapsed.
Figure 25:
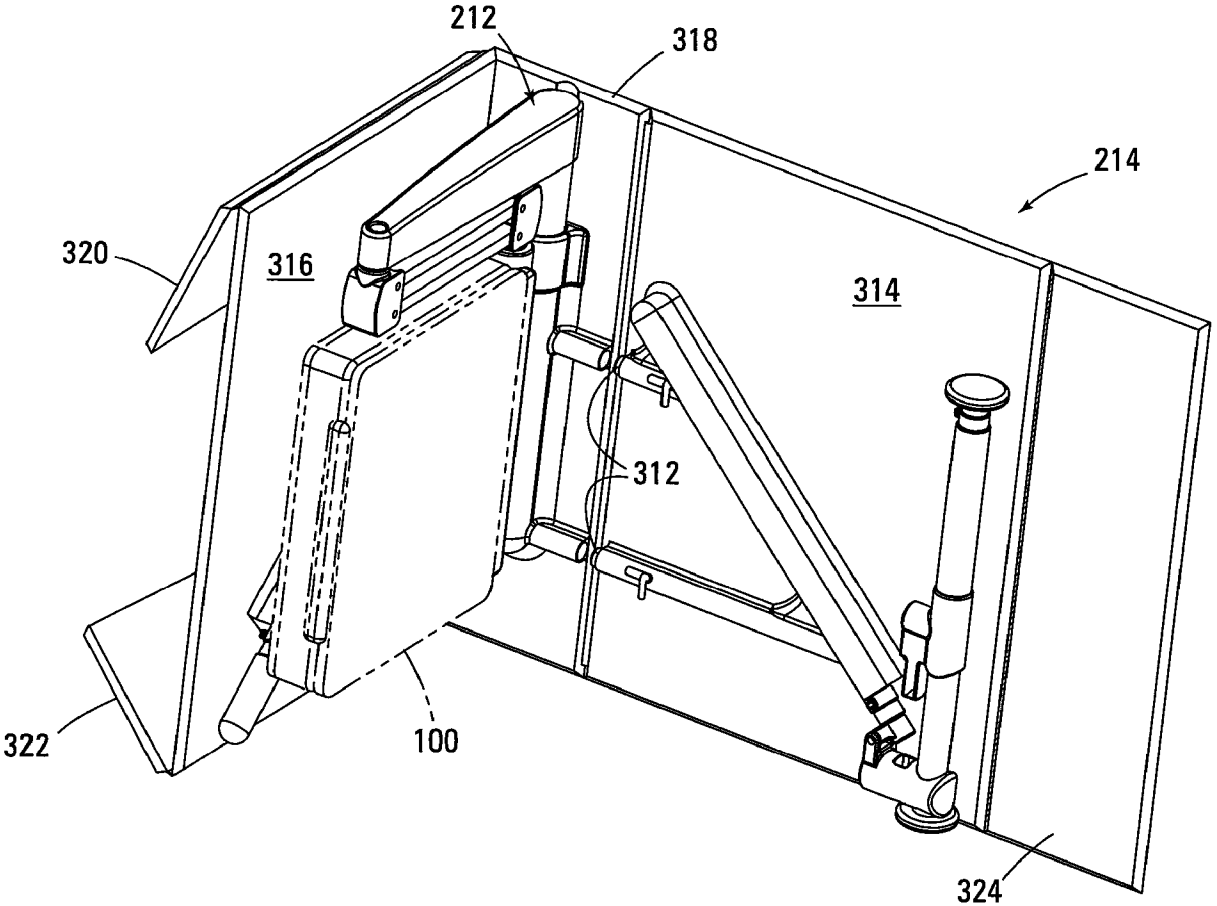
FIG. 25 is a detailed perspective view of the FIG. 15 embodiment of the workstation of the present invention showing the disengagement of the panel locks and the panels of the enclosure structure partially folded.

After collapsing the legs 228, 230, post 232 and floor beam 234, the enclosure structure 214 may then be folded by slidably disengaging the panel locking bolt 312 as shown in FIGS. 24 and 25. It should be appreciated that rather than using bolts 312 as shown, a lockable hinge or the like may also be utilized. It is preferred to provide a means for locking the panels with respect to one another to provide more lateral stability and to prevent the workstation from inadvertently collapsing. As shown in FIG. 24, in the preferred embodiment, the enclosure structure 214 is comprised of six panels. The first and second panels 314, 316 are preferably connected to the first and second legs 228, 230 respectively and are preferably foldably connected to the third panel 318, which is connected to the post 232. The fourth and fifth panels 320, 322 are preferably foldably connected to the second panel 316. The sixth panel 324 is preferably foldably connected to the first panel 314.

Figure 26:
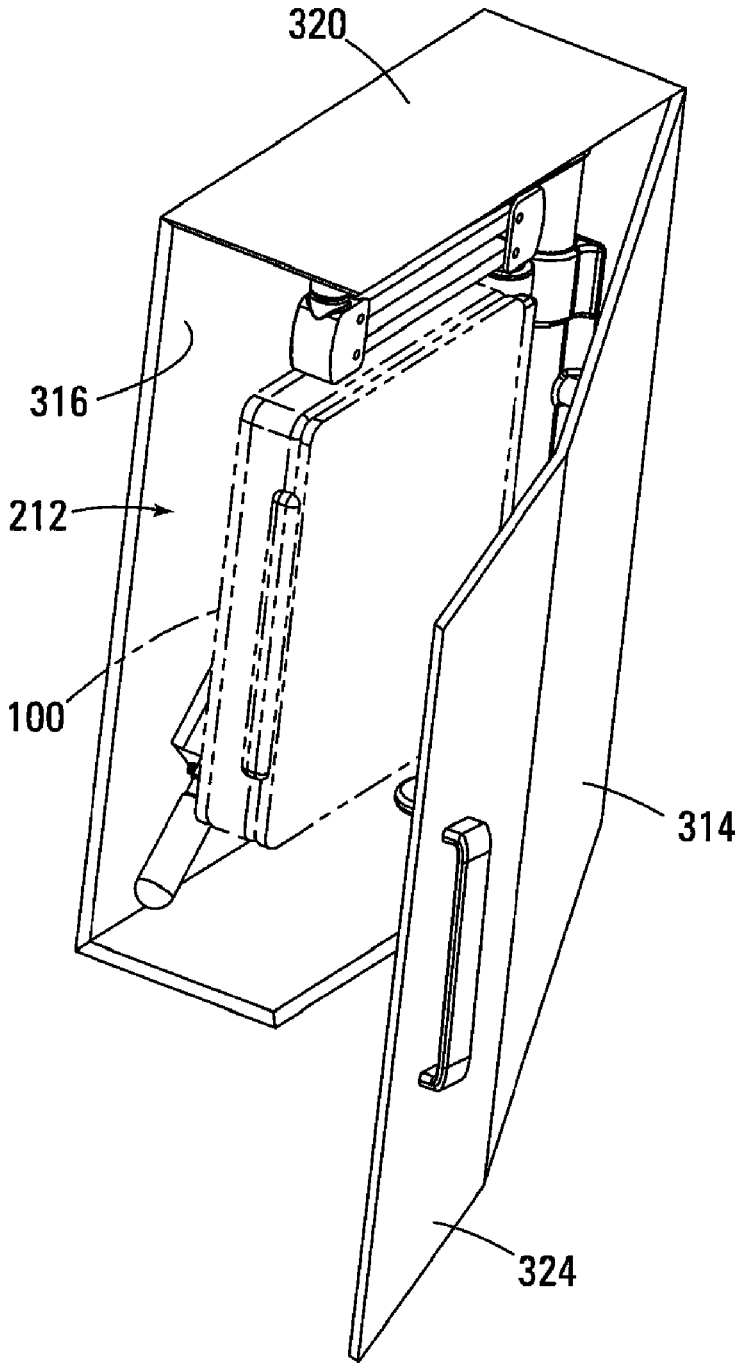
FIG. 26 is a perspective view of the FIG. 15 embodiment of the workstation of the present invention showing the panels substantially folded to enclose the workstation.

As shown in FIGS. 25 and 26, after releasing the panel bolts 312, the respective panels are foldable with respect to one another to completely enclose the articulating support structure 212 within the enclosure structure 214 as shown in FIG. 16.

It should be appreciated that the panels 314, 316, 318, 320, 322 and 324 comprising enclosure structure 214 of the portable workstation 210 of the present invention may be removable, in which event the enclosure structure 214 will simply comprise the articulating support structure 212 and the legs 228, 230 which simply collapse around the peripheral 100. The collapsed workstation 210 may then simply be placed in a bag for carrying or alternatively, a handle or other carrying means may be secured to the post 232 or to the arm bracket 224 for carrying the collapsed workstation without a separate carrying bag. Likewise, the portable workstation embodiments 10 of FIGS. 1 and 4 need not necessarily have panel segments 20*a*, 20*b* and 22*a*, 22*b* as part of the enclosure structure 14.

It should also be appreciated that multiple articulating arms may be attached to the post of the preferred embodiments of the workstations 10, 210 of the present invention for supporting additional peripherals.

Although only certain exemplary embodiments of the invention have been described in detail above, those skilled in the art will readily appreciate that many modifications are possible without materially departing from the novel teachings and advantages of this invention. Accordingly, all such modifications are intended to be included within the scope of this invention as defined in the following claims.

The invention claimed is:

1. A portable workstation, comprising:

(a) an enclosure structure;

(b) an articulating support structure operably connected to said enclosure structure, said enclosure structure and said articulating support structure movable in combination between an open usable position and a closed carrying case position, said articulating support structure having a distal end operably supporting a peripheral support, said peripheral support comprising a working platform upon which work is performed, said peripheral support movable with respect to said enclosure structure about at least two non-intersecting axis while in said open useable position, said articulating support structure further including:

(i) a post;

(ii) an arm bracket having a first end and a second end, said first end operably connected to said post when said workstation is in said open usable position;

(iii) an articulating arm segment having a first end and a second end, said first end of said arm segment rotatably connected to said second end of said arm bracket, and wherein said peripheral support is operably connected to said second end of said articulating arm segment;

(c) first and second legs movable between a collapsed position and an extended position.

2. The portable workstation of claim 1 further comprising at least one floor beam operably connected proximate one end to one of said first and second legs and movable with respect thereto.

3. The portable workstation of claim 1 wherein said articulating arm segment comprises a first arm segment and a second arm segment, said second arm segment rotatably supported by said first arm segment at a first end, said second arm segment rotatably supporting said peripheral support at a second end.

4. The portable workstation of claim 3 wherein said peripheral support is pivotable with respect to said second end of said second arm segment.

5. The portable workstation of claim 1 wherein said post is movable between an extended position and a collapsed position.

6. The portable workstation of claim 5 wherein said first and second legs are pivotally movable with respect to a vertical axis of said post between an unfolded position and a folded position.

7. The portable workstation of claim 6 further comprising a carrying means for carrying said carrying case.

8. The portable workstation of claim 6 wherein said enclosure structure comprises two sets of opposing panel segments, said first set of opposing panel segments attached to opposing sides of said arm bracket, each of said opposing panel segments of said second set of panel segments attached along one edge to one side of said post and along another edge to outwardly opposing sides of said first and second pivotally movable legs;

whereby when the workstation is in the closed carrying case position, said two sets of opposing panel segments form sidewalls of a substantially rectangular carrying case with said articulating support structure folded therein and between said opposing panel segments of said enclosure structure.

9. The portable workstation of claim 6 wherein said enclosure structure comprises a collapsible panel, said collapsible panel comprising at least first and second panel segments movable with said first and second legs between said unfolded position and said folded position, whereby said first and second panel segments substantially enclose said articulating support structure when said portable workstation is in said closed carrying case position.

10. The portable workstation of claim 9 further comprising third, fourth, fifth and sixth panel segments, wherein at least said fourth, fifth and sixth panel segments are moveable with respect to at least one of said first and second panel segments to substantially enclose said articulating support structure when said portable workstation is in said closed carrying case position.

11. A portable workstation, comprising:

(a) an enclosure structure;

(b) an articulating support structure operably connected to said enclosure structure, said enclosure structure and said articulating support structure movable in combination between an open usable position and a closed carrying case position, said articulating support structure having a distal end operably supporting a peripheral upon which work is performed, said distal end movable about at least two non-intersecting axis and with respect to said enclosure structure when in said open useable position, said articulating support structure further including:

(i) a post;

(ii) an arm bracket having a first end and a second end, said first end operably connected to said post when said workstation is in said open usable position;

(iii) an articulating arm segment having a first end and a second end, said first end of said arm segment rotatably connected to said second end of said arm bracket, and wherein said peripheral is operably connected to said second end of said articulating arm segment;

(c) first and second legs movable between a collapsed position and an extended position.

12. The portable workstation of claim 11 wherein said enclosure structure comprises a collapsible panel, said collapsible panel comprising at least first and second panel segments movable with said first and second legs between said unfolded position and said folded position, said first and second panel segments substantially enclosing said articulating support structure when said portable workstation is in said closed carrying case position.

13. The portable workstation of claim 12 further comprising third, fourth, fifth and sixth panel segments, wherein at least said fourth, fifth and sixth panel segments are moveable with respect to at least one of said first and second panel segments to substantially enclose said articulating peripheral support structure when said portable workstation is in said closed carrying case position.

* * * * *